United States Patent [19]

Diaz et al.

[11] Patent Number: 4,912,873

[45] Date of Patent: Apr. 3, 1990

[54] REMOVAL OF POLAR IMPURITIES FROM DIESEL AND JET FUEL

[75] Inventors: Zaida Diaz, Houston; James H. Miller, Katy, both of Tex.

[73] Assignee: Shell Oil Company, Houston, Tex.

[21] Appl. No.: 310,989

[22] Filed: Feb. 17, 1989

[51] Int. Cl.[4] ..... C10L 1/22

[52] U.S. Cl. ..... 44/57; 44/62; 208/12; 208/255; 208/299; 208/305; 208/310 R; 585/820; 585/823

[58] Field of Search ..... 208/12, 255, 263, 299, 208/305, 310 R; 585/820, 823; 44/62, 57

[56] References Cited

U.S. PATENT DOCUMENTS

| | | | |
|---|---|---|---|
| 2,566,353 | 9/1951 | Mills | 208/254 R |
| 2,884,384 | 4/1959 | Howell, Jr. et al. | 208/305 |
| 3,019,182 | 1/1962 | Chanmugam | 208/254 R |
| 3,053,774 | 9/1962 | Walther | 208/305 |
| 3,409,691 | 11/1968 | Small | 585/820 |
| 3,922,217 | 11/1975 | Cohen et al. | 585/823 |
| 4,290,881 | 9/1981 | Delacher et al. | 585/820 |
| 4,352,945 | 10/1982 | Bezman | 568/899 |
| 4,357,147 | 11/1982 | Bezman | 44/56 |
| 4,403,999 | 9/1983 | Bezman | 44/56 |
| 4,578,194 | 3/1986 | Reinartz et al. | 220/73 |

FOREIGN PATENT DOCUMENTS

| | | | |
|---|---|---|---|
| 61-020863 | 1/1986 | Japan . | |
| 1695996 | 5/1979 | U.S.S.R. | 585/823 |

*Primary Examiner*—Helane Myers

[57] ABSTRACT

Treatment of diesel or jet fuel with a non-ionic, macroreticular, cross-linked, acrylic aliphatic ester resin reduces polar impurities and (diesel) color.

3 Claims, No Drawings

REMOVAL OF POLAR IMPURITIES FROM DIESEL AND JET FUEL

FIELD OF THE INVENTION

The present invention relates to the removal of polar impurities from diesel and jet fuel.

DESCRIPTION OF THE ART

Diesel fuels are prepared from virgin oil stock or cracking stock by proper blending and additive selection to achieve easy starting and smooth combustion. Some diesel fuels may be stable by themselves but form a precipitate if blended with other (diesel) fuel stocks. Stabilizing agents can be used in an attempt to avoid or to prevent the formation of a precipitate if the stability of the fuel is unsatisfactory. Polar impurities, especially in the form of multi-cyclic acids, are particularly undesirable impurities in diesel fuel stocks because they can react with iron in a moist environment to form floc-like compounds which plug fuel filters, causing inconvenience and requiring repair. Chemical stabilizing of the diesel fuels containing such impurities is expensive and may not completely eliminate the problem. Jet fuels also can have similar kinds of impurities and problems.

Applicants have discovered a practical and effective means of solving the problem presented by these polar impurities. Moreover, a desirable reduction in diesel color is also obtained.

SUMMARY OF THE INVENTION

The present invention is directed to the removal of polar impurities from diesel or jet fuel comprising treating diesel or jet fuel with a non-ionic, macroreticular, cross-linked, acrylic aliphatic ester resin to effect removal of the polar impurities.

While resins of the above type are known to remove some impurities from aqueous and non-aqueous systems, such resins were previously recognized as being reduced in effectiveness with increases in the molecular weight of polar impurities in organic systems.

The process of the present invention is characterized in that diesel or jet fuel is passed through the resin. Although the process can be conducted batchwise or semi-continuously, it is preferably conducted in a continuous manner. This is conveniently accomplished by using the resin contained in cartridges for quick and easy exchange and regeneration.

The process of the instant invention for removing polar impurities from diesel or jet fuels is typically carried out by passing the fuels through the adsorption zone or zones at ambient temperatures (about 20° C. to about 50° C.), a feed rate in the range of about 5 to about 16 BV/hr (bed volumes per hour) and a pressure ranging from about 1 to about 10 atmospheres. Following exhaustion of the capacity of the adsorption zone(s), the resin is regenerated for reuse.

The resin that has been used to treat the diesel or jet fuel is regenerated by passing through the resin a solution containing a base, such as a solution of from about 0.2 to about 4 percent by weight sodium hydroxide in water. The regeneration step is carried out at about ambient temperatures, from about 20° C. to about 50° C., at flow rates ranging from about 1 to about 4 BV/hr and a pressure ranging from about 1 to about 10 atmospheres.

Both the effectiveness of the resins and the degree of treatment of the fuel by the resin are simply determined by one or more tests of titration of total acidity (e.g. with KOH) and floc formation in the presence of aqueous iron solution as illustrated in the examples hereinafter.

While multicyclic acid or acid acting compounds are typical of the classes of materials thought to be impurities, such is not intended to be limiting but merely to illustrate the kind of impurities which are thought to be removed from diesel or jet fuels utilizing the process of this invention.

The amount of diesel or jet fuel which can be treated by a particular amount of adsorbent will be dependent upon the concentration of polar impurities in the fuel and upon the particular impurity. A typical feed in the process of the instant invention will contain less than about 0.05% of impurities.

The process of the instant invention is generally carried out using a series of two zones, a first adsorption zone in which the polar impurities are removed and a second regeneration zone in which the resin is regenerated. For convenience and efficiency, the process for removing polar impurities may also be carried out with a parallel adsorption zone which can be placed on stream while the first adsorption zone is being regenerated.

Adsorbent materials suitable for the adsorption zone(s) in which substantially all of the polar impurities are removed are macroreticular polymers selected from a cross-linked polyacrylic ester. These polymeric adsorbent materials are available commercially in the form of hard, insoluble beads. While the beads are utilized in a manner similar to that employed for ion exchange resins, these polymeric adsorbents differ from ion exchange resins in that there are no ionic functional groups incorporated into the resin structure of the polymeric adsorbents. In the absence of functional sites, those polymeric adsorbents derive their adsorptive properties from a combination of macroreticular porosity, pore size distribution, high surface area and the nature of their structure, i.e., aliphatic or aromatic.

Macroreticular, cross-linked polyacrylic ester adsorbents suitable for use in the instant process in the first adsorption zone for removal of polar impurities are porous, essentially all aliphatic polymers composed of 2 to 100% by weight of a polyfunctional methacrylate containing at least three methacrylate groups. The adsorbents are prepared in the form of rigid, water-insoluble, white or opaque beads with particle sizes ranging from 10 to 900 microns. In terms of mesh size, it is preferred that the particle size be in the range of 20 to 60 mesh. The surface area of the cross-linked polyacrylate adsorbent is at least about 5 $m^2/g$, with the upper limit ranging as high as 2000 $m^2/g$. The preferred surface area is in the range of 300 to 500 $m^2/g$. The average pore diameter of the polyacrylate adsorbent is at least 15–20 Å. The preparation of these porous, macroreticular polyacrylic ester adsorbents is more fully described in U.S. Pat. No. 3,663,467, issued May 16, 1972, which is incorporated by reference herein. A suitable commercially available polyacrylic ester adsorbent can be obtained from Rohm and Haas under the trade name of XAD-7.

ILLUSTRATIVE EMBODIMENTS

The invention is illustrated in greater detail by the following embodiments, which should not be regarded as limiting the invention in any way. Embodiment 1.

Diesel fuel was contacted with XAD-7 adsorbent at room temperature in weight ratios of 500:1, 100:1 and 20:1 diesel fuel to adsorbent.

All samples of diesel fuel were analyzed by titration with KOH to give a total acid number (TAN). The samples of diesel fuel were also analyzed with a "floc test" which measured the amount of floc visually observed on contact with an aqueous iron solution containing 5 mM ferric sulfate in 5 mM sulfuric acid.

Results of the above experiments are set forth in Table I below:

TABLE 1

| | Diesel Fuel Adsorption Results | | |
|---|---|---|---|
| Adsorbent | Color[a] | Floc Grade[b] | TAN[c] |
| None | YO | D | 0.027[d] |
| XAD-7 | | | |
| 500/1 | — | — | 0.016 |
| 100/1 | DY | C | 0.013 |
| 20/1 | Y | C | 0.007 |

[a]YO = yellow-orange, DY = dark yellow, Y = yellow Unless noted all samples are YO.
[b]A is best, C is passing. Unless noted all samples are D.
[c]TAN = total acid number = mg KOH/g solution.
[d]Duplicate samples showed .025, .029.

Results of the above experiments demonstrate that XAD-7 non-ionic, macroreticular, cross-linked, acrylic ester resin is surprisingly effective in removing appreciable amounts of diesel fuel acidity (believed to be multiple cyclic carboxylic acid polar impurities) from diesel fuel and also in improving the color of diesel fuel from yellow-orange to a more desirable yellow color.

What is claimed is:

1. A process for the removal of polar impurities in diesel or jet fuel comprising treating the diesel or jet fuel with a non-ionic macroreticular cross-linked acrylic aliphatic ester resin to effect removal of the polar impurities.

2. A process for reducing the color of diesel fuel caused by color impurities comprising treating the diesel fuel with a non-ionic, macroreticular, cross-linked, acrylic aliphatic ester resin to effect removal of the color causing impurities.

3. A process for reducing plugging of fuel filters by floc-like compounds formed from impurities in diesel or jet fuel and iron in the presence of moisture comprising treating the diesel or jet fuel with a non-ionic, macroreticular, cross-linked, acrylic aliphatic ester resin to remove impurities which form the floc-like compounds.

* * * * *